US005728239A

United States Patent [19]

Setzer et al.

[11] Patent Number: 5,728,239

[45] Date of Patent: Mar. 17, 1998

[54] PROCESS FOR HARDENING ALUMINUM USING A MAGNESIUM ALLOY

[75] Inventors: William C. Setzer, Evansville, Ind.; Richard J. Malliris; David K. Young, both of Henderson, Ky.; Francis P. Koch, Tomales, Calif.

[73] Assignee: KBAlloys, Inc., Robards, Ky.

[21] Appl. No.: 470,760

[22] Filed: Jun. 6, 1995

Related U.S. Application Data

[63] Continuation-in-part of Ser. No. 386,698, Feb. 10, 1995.

[51] Int. Cl.[6] ..... C22F 1/04

[52] U.S. Cl. ..... 148/549; 148/551; 148/666; 148/420; 148/440

[58] Field of Search ..... 148/538, 549, 148/551, 666, 420, 440; 420/402, 407

[56] References Cited

FOREIGN PATENT DOCUMENTS 1727403 11/1994 Russian Federation .

OTHER PUBLICATIONS

Proffitt, Henry "Magnesium and Magnesium Alloy", Metals Handbook, 9th Ed, vol. 15, 1989 pp. 798–810.

*Primary Examiner*—Sikyin Ip
*Attorney, Agent, or Firm*—Bachman & LaPointe, P.C.

[57] ABSTRACT

A process for hardening aluminum comprises the steps of adding a magnesium hardener to molten aluminum wherein the hardener has a magnesium content in the range of 64–72 wt % based on the weight of the hardener, with a remaining portion of the hardener comprising aluminum. The process may further include the steps of preheating the hardener prior to adding the hardener to the aluminum for decreasing a temperature differential between the hardener and the aluminum so as to stabilize the hardener and prevent shattering thereof.

8 Claims, 2 Drawing Sheets

PROCESS FOR HARDENING ALUMINUM USING A MAGNESIUM ALLOY

CROSS-REFERENCE TO RELATED APPLICATION

This application is a continuation-in-part of U.S. patent application Ser. No. 08/386,698, filed Feb. 10, 1995.

BACKGROUND OF THE INVENTION

This invention relates to hardeners, and more particularly, to a magnesium based alloy used as an aluminum hardener.

Aluminum metal alloys are highly desirable materials for use in construction, manufacturing processes and structural devices. Aluminum alloys are particularly desirable because of their light weight and strength. However, one draw back of pure aluminum is its hardness. That is, pure aluminum is much softer than metals such as iron and steel, and thus, tends to be more easily damaged. Pure aluminum's mechanical and physical properties, however, can be enhanced by using alloying elements. These alloying elements are commonly referred to as hardeners.

Aluminum based master alloys which contain hardener elements in high concentrations, provide a convenient and economical way to supplement aluminum to achieve desired properties. Generally, these master alloys readily melt when alloyed into pure aluminum, which minimizes dross formation. Because of this, lower furnace temperatures can be used which reduces hydrogen solubility, energy consumption and prolongs furnace life. Aluminum hardeners are available on the market which use magnesium as the hardening element and which include the magnesium in different percentages based on the weight percent of the alloy. However, the current aluminum hardeners which are available, include some unappealing physical properties.

The benefit of using hardener alloys can be seen by analyzing the results when using pure magnesium to strengthen aluminum. Typically, when magnesium is added to aluminum in its pure form, the pure magnesium cannot be readily alloyed because of several problems. Firstly, the melting point of pure aluminum is 1220° F., and because the melting point of pure magnesium is 1202° F., even with some super heat in the aluminum, there is very little driving force to melt pure magnesium quickly in aluminum without raising it to a high temperature. Secondly, magnesium is less dense than aluminum and as a result, magnesium tends to float high in the aluminum, exposing the magnesium to oxygen and possibly burning. Such loss to oxidation lowers the recovery of magnesium. Thirdly, because pure magnesium takes longer to melt, time becomes a factor, thus resulting in extended furnace cycles and resulting in increased oxidation even after the magnesium has been placed into solution. The alloys available on the market deal with these problems but only to a limited degree.

Three aluminum master alloys are presently being produced: 10% magnesium, 25% magnesium and 50% magnesium-aluminum alloys. The 10% and 25% magnesium alloys are not cost effective for several reasons. The main reason is that they are dilute so they require large additions in order to achieve the required magnesium level. On a unit magnesium addition basis, it is very difficult to produce material which can compete with higher magnesium level products, even when assuming high efficiencies and rapid dissolution rates. This material is also susceptible to shrinkage cavities which can be extremely hazardous if they are exposed to moisture.

A 50% magnesium-aluminum alloy hardener is more cost effective when compared to the 10% and 25% product.

However, it does have the disadvantage that the material is extremely brittle because it is 100% intermetallic having no phase with any degree of ductility and cannot be produced in a solid ingot or waffle form without extreme process control consideration. It is also so brittle as to be very susceptible to in transit breakage. Also the 50% magnesium product is considered a flammable solid when in powder form and due to its brittle nature, fines may be generated during production and transit. Since these fines are flammable and can rapidly oxidize, they pose an explosion safety hazard. Further, as with high magnesium alloys, the 50% alloy material will burn intensely when water is added. There is a chemical reaction which takes place between the magnesium and water which exothermally forms magnesium oxide and concurrently releases hydrogen, further intensifying the flame. An advantage of the 50% magnesium alloy over the 25% and 10% alloy is that the melting point is relative low, at 864° F., therefore not requiring a relatively large driving force for placing the alloy into solution.

For both the 25% and 50% magnesium alloys, typical magnesium recoveries exists only at 90–93%, the higher values being achieved by the 25% magnesium due to the fact that it is not brittle. As is obvious from this range, consistency in determining recoveries is limited and determined to a great extent by variations in the manufacturing process for the alloy.

Magnesium aluminum alloys are also used for purposes different than hardening pure aluminum. The prior art does disclose a magnesium aluminum alloy having a magnesium content of 72–85% magnesium based on the weight percent of the alloy. This alloy is found in U.S. Pat. No. 3,505,063 wherein a method is disclosed for condensing magnesium vapors by contacting the vapors with an aluminum base alloy at a temperature below about 600° C. The alloy preferably contains 75% aluminum and 25% magnesium before condensation and 72–85% magnesium after condensation of the vapors.

There exists, therefore, a need for a more concentrated hardener and a process for producing the hardener which comprises a magnesium based alloy used for hardening aluminum, wherein the alloy does not display safety hazards, excessive addition rates, excessive oxidation, extreme brittleness and which is cost efficient.

SUMMARY OF THE INVENTION

The primary object of this invention is to provide a process for use in hardening pure aluminum.

Still another object of this invention is to provide a magnesium alloy which is not particularly subject to oxidation and burning due to its relatively low melting point and rapid dissolution rate for use in a process for hardening aluminum.

And still another object of this invention is to provide a magnesium alloy for use in a process for hardening aluminum which provides substantially higher magnesium recovery when added to aluminum, relative to currently available processes.

Yet another object of this invention is to provide a stabilized process for hardening aluminum.

The foregoing objects are obtained by the process for hardening aluminum of the instant invention which comprises the steps of adding a magnesium hardener to molten aluminum, wherein the hardener has a magnesium content in the range of 64–72 wt % based on the weight of the hardener, with a remaining portion of the hardener comprising aluminum. The process may further include the steps of preheating the hardener prior to adding the hardener to the aluminum for decreasing a temperature differential between the hardener and the aluminum so as to stabilize the hardener and prevent shattering thereof.

The details of the present invention are set out in the following description and drawings wherein like reference characters depict like elements.

DETAILED DESCRIPTION OF THE PREFERRED EMBODIMENT

The alloy of the present invention comprises magnesium in the range of 64–72 wt. %, and preferably 68–72 wt. %, based on the weight of the alloy with the remaining portion comprising aluminum. The alloy preferably exhibits a melting point ranging from 819° F. to 910° F. The concentration of magnesium in the alloy preferably forms a eutectic or quasi-eutectic composition having a 64.9–84.5% range of intermetallic MgAl, a reduced microporosity, and a solidification range approximately 437° C.–449° C. at 64 wt. % and approximately 437°–487° C. at 72 wt. %. Accordingly, the 64–72 wt. % alloy solidifies over ranges having a temperature span of 12°–50° C. In one particular embodiment, the magnesium is present at 70 wt. % based on the weight of the alloy and has a melting point of approximately 887° F. and 69–70%, particularly 69.8% of intermetallic MgAl. Due in part to the percentage of MgAl intermetallic, the alloy of the present invention including magnesium in the range of 64–72 wt. %, and preferably 68–72 wt. %, and particularly 70 wt. % is significantly more ductile than the magnesium alloys of the prior art, i.e. specifically the 25 wt. % and 50 wt. % magnesium alloys.

Figure 1:
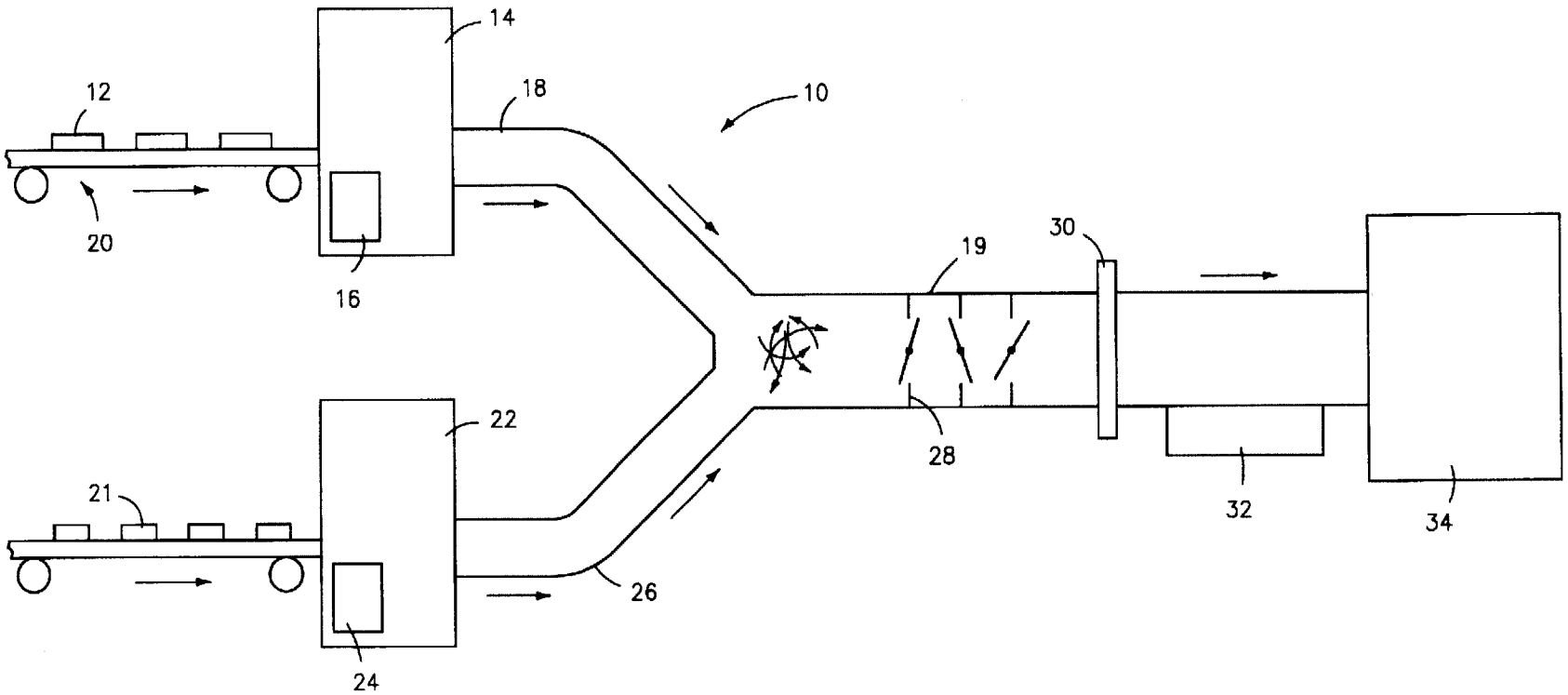
FIG. 1 is a schematic diagram of the process disclosed herein for hardening aluminum via the magnesium alloy.

Referring now to the drawings in detail there is shown in FIG. 1 a schematic view of a process of the instant invention for producing a 64–72 wt %, and preferably 68–72 wt %, and particularly 70 wt % magnesium alloy of the present invention for hardening pure aluminum, designated generally as 10.

At the beginning of process 10, magnesium metal in any structure or form, such as ingots, sows or bars 12 are conveyed into furnace 14, if a source of molten magnesium is not otherwise available. Within furnace 14, metal bars 12 are melted to a molten state. Accordingly, furnace 14 must be raised to a temperature in excess of the melting point for melting bars 12. The temperature raised to should be high enough to efficiently melt the magnesium metal at a rate which is compatible to the rate in which the solid metal is added and the molten metal is extracted. When the magnesium metal bars 12 are transformed into a molten state, the molten magnesium metal is preferably syphoned or pumped via pump 16 into piping 18. The magnesium melt is directed to a conveyance container preferably in the form of a larger pipe or higher metal velocity pipe 19 which acts as a mixing vessel wherein the molten magnesium is mixed with molten aluminum. A conveying system 20 is preferably used for continually providing furnace 14 with magnesium metal bars if molten magnesium is not otherwise available.

If furnace 14 is open to the atmosphere, magnesium oxide may be generated during the melting of the pure magnesium bars. A manner for overcoming this problem is to inert the surface of the magnesium melt. This can be accomplished in several ways. A closed system can be designed which has the capacity to be purged with air and an inert gas, preferably at least one of argon, nitrogen, $CO_2$ and $SF_6$. It is important that the atmosphere not be made completely inert so as to minimize explosion potential by preventing instantaneous spontaneous oxidation upon exposure to air. Accordingly, some air is preferably always present in the closed system.

Another way of reducing the generation of oxide during the melting process, would be to add an inert floating molten salt cover to the melt. Commercial salts are available which contain Mg $Cl_2$ specifically for this purpose. Because the density of the magnesium alloy of this invention is higher than the density of pure magnesium, there is better separation of the low density salt flux from the melt. Accordingly, the salt flux tends to segregate to the top of the melt much more rapidly thereby assuring that the melt is not contaminated with the salt flux and that prevention of oxidation takes place much more securely. Still another way by which oxidation can be minimized is by adding beryllium to the melt. Specifically, only two parts per million may be used in order to minimize oxidation. This can be accomplished by adding an aluminum master alloy hardener containing 3–5% beryllium when the melt exceeds 1200° F. Accordingly, when the alloy is used for hardening aluminum, only a very small fractional part per million of beryllium is present in the final material.

Similar to the addition of magnesium as described above, if a source of molten aluminum is not available, aluminum bars 21 are conveyed into a furnace 22 wherein the aluminum bars are melted. A pump 24 or syphon is used to move the molten aluminum into pipe 26 through which the molten aluminum is directed to conveyance container 19 such as the large or high velocity pipe. Accordingly, preferably both the magnesium and aluminum are directed to pipe 19 through piping 18 and 26, respectively. At the point of combination, turbulence within pipe 19, as indicated by the arrows of FIG. 1, should be sufficient to mix the materials. However, if the turbulence is not sufficient, baffles 28 can be provided upstream in pipe 19 to provide for more mixing. Upstream or downstream of the mixing point, a filter 30 can be included to remove aluminum and/or magnesium oxide that was previously present or generated during the melting or holding process.

In order to properly cast the alloy, the alloy melt should have a temperature below 970° F. Because the magnesium and aluminum metal is melted at temperatures ranging from approximately 1200° to 1300° F., the melt preferably is cooled prior to casting. Accordingly, a heat exchanger 32 is preferably provided at the outlet end of pipe 19 so that heat is extracted from the melt until the melt acquires a temperature of less than 970° F. The alloy is then pumped into mold 34 where the alloy is solidified, depending on the mold, into at least one of sows, waffle ingots, notched ingots, broken ingots, direct chill slab or billet ingots, T-bar, flake, buttons and rods. In any of these forms, the alloy is used for hardening aluminum. After casting, it is preferable to slow cool the slabs or sows or the like in order to minimize or eliminate stresses which could be formed in the casted sows. Slow cooling can be done simply in air. For example, a 500 lb. slab is preferably cooled in air for 5–10 minutes.

Prior to the 64–72 wt %, and preferably 68–72 wt %, and particularly 70 wt % magnesium alloy, a concern with magnesium alloys was the formation of surface connected shrinkage cavities therein which could entrap water leading to safety problems when used as a hardener. However, with the 64–72 wt %, preferably 68–72 wt % and particularly the 70 wt % magnesium alloy, the formation of such surface connected cavities are controlled by mold design, mold temperature, exposed surface temperature, and melt temperature. While it is, of course, desirable that no cavities be present in the castings of the alloy of the present invention, if cavities are present, they are typically totally encapsulated so that moisture cannot enter the solidified product. Accordingly, these safety problems are averted. However, as discussed below, precautions may still be taken by cracking the alloy sows prior to use.

To make minor magnesium chemistry adjustments to a magnesium alloy melt prior to casting, it is preferable that additional small magnesium or aluminum solids be added thereto. It is also preferable to use magnesium or aluminum structures or solids such as waffles, buttons, or shot. It is also possible to use 64–72 wt %, preferably 68–72 wt %, and particularly 70 wt % alloy versions of these structures for chemistry adjustments, for they dissolve rapidly with little magnesium loss because the magnesium alloy has a higher density than pure magnesium which causes it to sit lower in the melt. Once submerged in the melt, they dissolve rapidly and do not float back to the surface.

Figure 2:
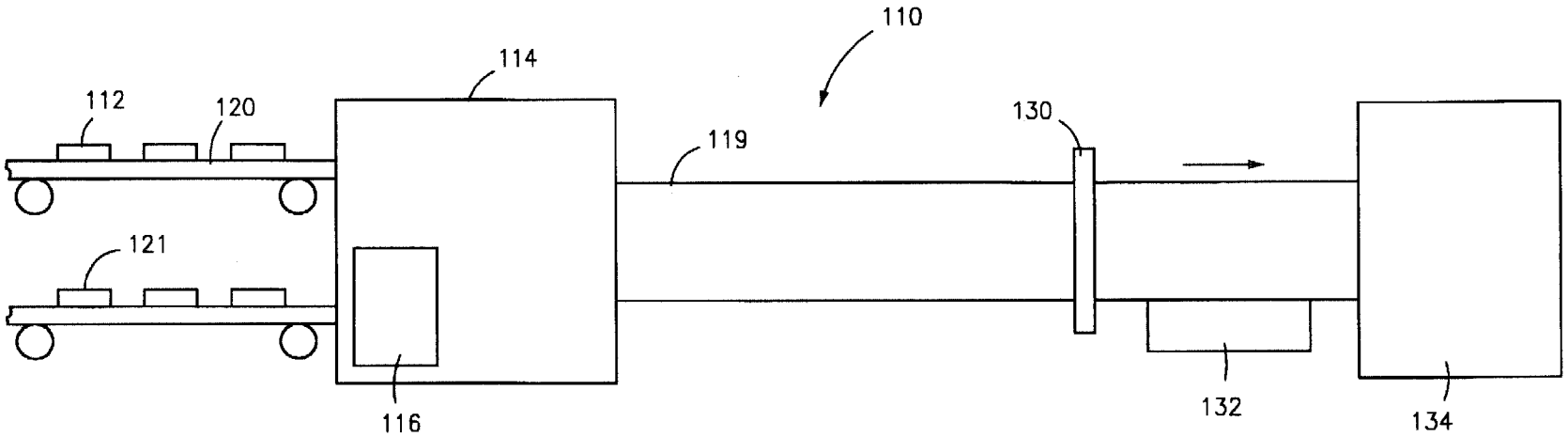
FIG. 2 is a schematic diagram of another embodiment of the process in accordance with the principles of the present invention.

As an alternative to the above, either or both the aluminum and magnesium can be melted and combined in a single furnace as shown in process 110 of FIG. 2. With this alternative, the furnace 114 will preferably be an induction furnace. By this process, the threat of oxidation is greater and therefore several preparatory steps with relation to aluminum metal 121 and magnesium metal solids 112 should be taken.

Melting magnesium bars 112 by mixture into molten aluminum can take an extended amount of time wherein the magnesium will tend to oxidize extensively. One step which can be taken to preclude such oxidation is preheating the aluminum. That is, if the aluminum contains a high amount of super heat, a larger portion of the solid magnesium metal can be added at a quicker rate without having to worry about the metal temperature dropping below the melting point. In addition, the magnesium will also melt faster since there is a larger temperature gradient between the super heated aluminum and the temperature of the magnesium.

An additional step for improving through put of the magnesium into the aluminum, in addition to or separate from super heating the aluminum, is preheating the magnesium. However, in order to prevent potentially large problems with the burning of magnesium, it is preferable to preheat the magnesium bars individually and with indirect fire to prevent burning. By individual heating, if a problem with burning occurs, only one bar or the like is potentially lost. The use of direct fire for preheating is not suggested in that even with a temperature as low as 500° F., direct fire can lead to magnesium fires.

In accordance with preheating the magnesium bars as rapidly as possible and with indirect heat, it is preferable to place the bars on a conveyor system 120 which has a rapid indirect heating ability. The conveyors can be set up at a speed such that the magnesium is added at a constant rate to the furnace. This will produce less variability in the process and reduce cycle time.

Similar to the above embodiment of FIG. 1, once the magnesium and aluminum alloy melt is obtained, it is necessary to reduce the temperature of the melt to below 970° F. for casting while minimizing magnesium burning. That is, casting at higher temperatures in an oxidizing atmosphere may cause magnesium to burn spontaneously resulting in heavy metal losses. Accordingly, the alloy melt, having reached 1200° F. should be cooled to below 970° F. prior to casting and prior to being syphoned or pumped via pump 116 through piping 119 to mold 134. Without assistance, an extended amount of time is needed to cool the alloy melt. In order to increase the rate with which the melt cools, pure magnesium metal bars or the like are preferably added to the alloy melt until the final temperature of the molten alloy is below 970° F. Since this temperature is significantly below the melting point of magnesium, less than 1–2% of the magnesium will dissolve. Consequently, this portion of magnesium is now super heated to below 970° F. in the furnace, reducing the amount of time and heat needed to melt the magnesium for the next run of melting the aluminum and magnesium, while providing the melt with the desired casting temperature.

As with the first embodiment, another option in quenching the melt, is to run the melt, at 1200° F., through a heat exchanger 132 for reducing the temperature to an appropriate level for casting. Also, a filter 130 can be used downstream of furnace 114 to remove oxides from the melt.

After the magnesium and aluminum melt alloy is quenched, i.e. reduced to a temperature below 970° F., it is cast into mold 134. After casting, super heated aluminum is added to the furnace and the remaining solid magnesium charge which has been preheated to below 970° F., is heated under full power, such that enough energy is added to the melt to melt the magnesium and stabilize the temperature around 1200° F. Additional magnesium and/or aluminum can be added to this melt for providing the desired 64–72 wt %, preferably 68–72 wt %, and particularly 70% magnesium chemical makeup. Similar to the above, in order to prepare the melt for casting, immediately before casting, additional magnesium bars may be added to the melt for dropping the temperature below 970° F. for casting. This cycle is preferably continuously repeated.

In using the magnesium alloy hardener of the present invention obtained through both processes discussed above, because of the possibility of surface or encapsulated moisture as discussed above, prior to placing 64–72 wt %, preferably 68–72 wt %, and particularly 70 wt % magnesium alloy structures into aluminum melt, for use in hardening aluminum or into the alloy melt for adjusting chemistry, the structures or sows are preferably preheated, for example, via placement at the hearth of a furnace. On the hearth or sill of the furnace, the structures are preheated to between 300°–500° F., preferably between 400°–500° F., prior to being pushed into the aluminum melt. After placement on the hearth, the sow may split due to thermal stress along lines of high stress concentration, generally breaking into two parts within two to five minutes. Such cracking will expose any possible porosity and shrinkage cavities and thereby allow surface and any other moisture which might have become incorporated into the sow due to outside storage, etc. of the ingot to be exposed and evaporated. This reduces hydrogen pick up in the melt and eliminates any potentially volatile reaction between moisture and the melt. The rapid dissolution of the 64–72 wt %, preferably 68–72 wt %, and particularly 70 wt % magnesium sows reduces processing cycle time for magnesium alloys and insures high recovery due to minimal oxidation.

In addition to cracking and exposing encapsulated moisture, the preheating of the structures or sows to 300°–500° F. functions to decrease the temperature differential between the molten aluminum to which the hardener is being added and the structures. As a result, the structures, i.e., sows or other formations are stabilized with respect to the aluminum melt. That is, the possibility of explosion, shattering, the throwing of floaters or solids of metals, and popping and cracking, is reduced or eliminated.

In addition to preheating, in order to further prevent such cracking or shattering or the like, it is preferable to target the magnesium percentage toward the higher end of the range, i.e., 70 wt. % and above and not go below 68 wt. %. After the preheating step, the sows or the like are prepared for placement into the aluminum melt at 1300°–1400° F.

In order to further reduce oxidation which is prevalent in both of the above discussed processes, when pumping or syphoning the melt through the system, pump 116 should be constructed of insoluble metals or other non-reactive and inert materials. This type of pump will not deteriorate rapidly and does not contribute either impurities or oxides to the metal. The metal which is being pumped or circulated from the bottom of the furnace and directed to the molds during casting, eliminates cascading metal and prevents any impurities which are lighter than the alloy and have floated to the top from being contained in the metal as it is being pumped.

Accordingly, the metal can be pumped immediately from the furnace to the mold without exposure to the atmosphere. Pump 116 can also be used to circulate the metal in the furnace during the making process. This minimizes the amount of chemical and temperature stratification during the making process and would decrease the cycle time for making the melt. By reducing the cycle time, there is less time for oxide generation. Additionally, by using a pump or syphon the melt can be decanted some distance off the bottom of the furnace which allows less dense particles, such as magnesium oxide and salt fluxes, to remain on the surface of the melt in the furnace and act as a protective cover while heavier particles remain in the furnace during a settling period.

One problem, however, with using a pump in such a system is the erosion of the bearing region due to loading, which occurs in this region at high temperatures. By injecting boron nitride into the bearing region, wetting of the bearing region is prevented. This increases the life of the bearing material and therefore the life of the pump.

The primary advantage of this invention is that a process is provided for use in hardening pure aluminum. Still another advantage of this invention is that a magnesium alloy is provided which is not particularly subject to oxidation and burning due to its relatively low melting point and rapid dissolution rate for use in a process for hardening aluminum. And still another object of this invention is that a magnesium alloy is provided for use in a process for hardening aluminum which provides substantially higher magnesium recovery when added to aluminum, relative to currently available processes. Yet another object of this invention is that a stabilized process is provided for hardening aluminum.

It is to be understood that the invention is not limited to the illustrations described and shown herein, which are deemed to be merely illustrative of the best modes of carrying out the invention, and which are susceptible to modification of form, size, arrangement of parts and details of operation. The invention rather is intended to encompass all such modifications which are within its spirit and scope as defined by the claims.

What is claimed is:

1. A process for hardening aluminum comprising the steps of:

adding a magnesium alloy hardener to molten aluminum wherein said hardener is a magnesium base alloy consisting essentially of magnesium in the range of 68–72 wt % based on the weight of the magnesium alloy hardener, with a remaining portion of the magnesium alloy hardener consisting essentially of aluminum, wherein said magnesium alloy hardener includes MgAl intermetallic in the range of 64.9 to 84.5% by weight and has a solidification range spanning 12° to 50° C.;

preheating the magnesium alloy hardener prior to adding the magnesium alloy hardener to the molten aluminum, including the step of decreasing any temperature differential between said magnesium alloy hardener and the aluminum for stabilizing and preventing shattering of said magnesium alloy hardener, and wherein said magnesium alloy hardener is preheated to a temperature range of 300°–500° F., thereby hardening the aluminum and obtaining high magnesium recovery.

2. The process according to claim 1, wherein during said step of preheating, said magnesium alloy hardener is preheated to a temperature in the range of 400°–500° F.

3. The process according to claim 1, wherein the step of preheating further includes the step of cracking said magnesium alloy hardener for releasing any moisture encapsulated in said magnesium alloy hardener for preventing explosion.

4. The process according to claim 3, further including placing the magnesium alloy hardener on a hearth of a furnace for facilitating the steps of preheating and cracking.

5. The process according to claim 1, wherein the magnesium is present in the range of 70–72 wt. % based on the weight of the magnesium alloy hardener.

6. The process according to claim 1, wherein said magnesium alloy hardener consists essentially of magnesium present at 70 wt. % with said intermetallic MgAl present at 69 to 70% by weight.

7. The process according to claim 1, wherein at a magnesium content of 72 wt. % said magnesium alloy hardener has a solidification range of 437° C. to 487° C.

8. The process according to claim 1, wherein the molten aluminum is maintained at a temperature of 1300° to 1400° F.

* * * * *